US005943883A

United States Patent [19]

Plath et al.

[11] Patent Number: 5,943,883

[45] Date of Patent: Aug. 31, 1999

[54] CIRCULAR KNITTING MACHINE

[75] Inventors: Ernst-Dieter Plath, Albstadt; Peter Rehm, Bitz; Dietmar Tränkle, Balingen; Gero Schindler, Albstadt-Margethausen; Paul Neher, Messstetten, all of Germany

[73] Assignee: Sipra Patententwicklungs u. Beteiligungsgesellschaft mbH, Albstadt, Germany

[21] Appl. No.: 08/714,459

[22] Filed: Sep. 16, 1996

[30] Foreign Application Priority Data

Sep. 21, 1995 [DE] Germany ..... 195 35 087

[51] Int. Cl.[6] ..... D04B 35/00

[52] U.S. Cl. ..... 66/145 R

[58] Field of Search ..... 66/145 S, 145 R, 66/140 S, 125 R, 134, 8

[56] References Cited

U.S. PATENT DOCUMENTS

| | | | |
|---|---|---|---|
| 3,006,173 | 10/1961 | Shoaf | 66/145 S X |
| 3,079,779 | 3/1963 | Butler et al. | 66/145 S X |
| 3,164,975 | 1/1965 | Haberhauer | 66/145 S X |
| 3,225,571 | 12/1965 | Mahler | 66/145 S X |
| 3,645,778 | 2/1972 | Minton | 66/145 S |
| 3,760,608 | 9/1973 | Lonati | 66/145 S X |
| 5,031,422 | 7/1991 | Plath | 66/145 S |
| 5,613,376 | 3/1997 | Ando' | 66/145 S X |

FOREIGN PATENT DOCUMENTS

| | | |
|---|---|---|
| 3135702A1 | 3/1983 | Germany . |
| 3145307C2 | 5/1984 | Germany . |
| 3712673C1 | 8/1988 | Germany . |
| 3812124C2 | 3/1990 | Germany . |
| 2218114 | 4/1988 | United Kingdom . |

*Primary Examiner*—John J. Calvert
*Assistant Examiner*—Larry D. Worrell, Jr.
*Attorney, Agent, or Firm*—Michael J. Striker

[57] ABSTRACT

A circular knitting machine for knitting patterned knitted fabrics (19) contains a preferably rotatable needle carrier (1) having knitting needles (3) distributed along a needle ring, selection devices (6) for selection of the knitting needles (3) in accordance with the pattern, a plurality of yarn guides (17) attached to the selection devices (6) to feed yarns (18) to the knitting needles (3), whereby these yarn guides (17) are arranged so that the yarns (18) are picked up by selected knitting needles (3) and tied into the knitted fabric (19) but passed over by non-selected knitting needles (3) with the formation of yarn floats, and at least one cutting device located within the needle ring for cutting through yarn floats of a given minimum length such that yarn ends on the fabric side and the yarn guide side are formed and the yarn ends on the yarn guide side remain in a position in the catchment area of the selected knitting needles that intersects with the needle ring. The cutting device has two cutting elements (23,24), one of which is a knife (24) preferably rotating with the needle carrier (1) and the other of which is a shearing blade (23) attached to it, and at least one catch element (53) preferably rotating with the knife (24) for positioning the yarn floats relative to the cutting elements (23, 24) (FIG. 3).

26 Claims, 7 Drawing Sheets

CIRCULAR KNITTING MACHINE

The invention relates to a circular knitting machine for knitting patterned knitted fabrics, containing a needle carrier having knitting needles distributed along a needle ring, selection devices for selecting the knitting needles in accordance with the pattern, a plurality of yarn guides located on the circumference of the needle ring and assigned to the selection devices for feeding yarns to the knitting needles, whereby these yarn guides are positioned so that the yarns are caught by selected knitting needles and tied into the knitted fabric but are passed over by non-selected knitting needles with the formation of yarn floats that form yarn chords (or strings) protruding into the needle ring, and at least one cutting device located inside the needle ring for cutting through yarn floats of a given minimum length such that yarn ends on the fabric side and on the yarn guide side are formed and the yarn ends on the yarn guide side remain in a position intersecting the needle ring in the catchment area of the selected knitting needles.

Circular knitting machines of this type (DE 38 12 124 C2) primarily serve the purpose of avoiding the formation of undesirably long floats and the necessity of undertaking special steps to tie excessively long floats into the knitted fabric when producing patterned knitted fabrics without the use of yarn-changing devices. Floats of this kind lead not only to high yarn consumption but can also interfere with the subsequent finishing operation, such as the shearing operation, or can wrap around the central rod of the circular knitting machine. In this situation it is basically immaterial whether in the individual case the machines in question are what are referred to as single machines having only one needle bed for the production of jacquard designs, horizontal striped patterns or the like, or whether they are circular knitting machines for the production of plush fabric or of other knitted fabrics produced with two or more yarns, such as those having reinforcement surfaces, or whether the particular yarn that forms the floats is a ground thread or another yarn in the form of a plush or reinforcing yarn or the like.

The cutting device of the known circular knitting machine consists of a cutting knife in stationary position, driven rotationally by an electric motor, and, optionally, of a suction or blower nozzle for keeping the yarn ends taut on the yarn guide side. Since the cutting device is mounted in a stationary position but the yarn floats that need to be cut are moved past the cutting knife at a high relative velocity depending on the speed of the needle cylinder, there is no clearly defined cutting point on the yarn. Besides, the cutting point exposed to the cutting knife remains stationary for a brief period, while the part of the float on the fabric side continues to move. This is sufficient to stretch the yam end on the fabric side elastically and allow it to recoil in uncontrolled fashion after the cutting operation is completed. The stretching of the yarn end on the fabric side can result in the distortion, and especially the shortening, of loop elements such as stitches or plush loops. A further consequence of this is that in a downstream knitting system the yarn end on the fabric side can get into the area of the selected knitting needles and be knitted by this system as well, which is undesirable. Aside from that, cutting devices operating with rotary cutting knives have inadequate cutting properties and comparatively short service lives.

The invention is therefore based on the object of designing the circular knitting machine of the kind described above so that it has improved cutting properties.

A further object of this invention is to design the circular knitting machine such that uncontrolled recoiling, especially of the yarn ends on the fabric side, can largely be prevented.

Yet another object of this invention is to provide the circular knitting machine with means by which the yarn floats can be safely laid into the cutting instrumentalities such that all floats having a given minimum length will be safely cut.

These and other objects of the invention are solved by a circular knitting machine which is characterized in that the cutting device has two cutting elements, of which the one is a knife and the other is a shearing blade assigned to it, and at least one catch element associated with the knife for positioning the yarn floats relative to the cutting elements.

The invention offers the advantage that the knife rotates with the needle cylinder and therefore even during the cutting operation has the same circumferential speed as the yarn ends being formed on the fabric side, so that the latter cannot stretch. In a particularly preferred embodiment of the invention, this [stretching] effect is also counteracted by the fact that the speed at which the knife rotates is selected so as to be slightly higher, 10% higher for example, than the needle cylinder speed, and this also relieves pressure on the yarn end on the fabric side during the cutting operation.

The invention will be described in greater detail below by reference to embodiments in connection with the enclosed drawings, in which.

Figure 2:
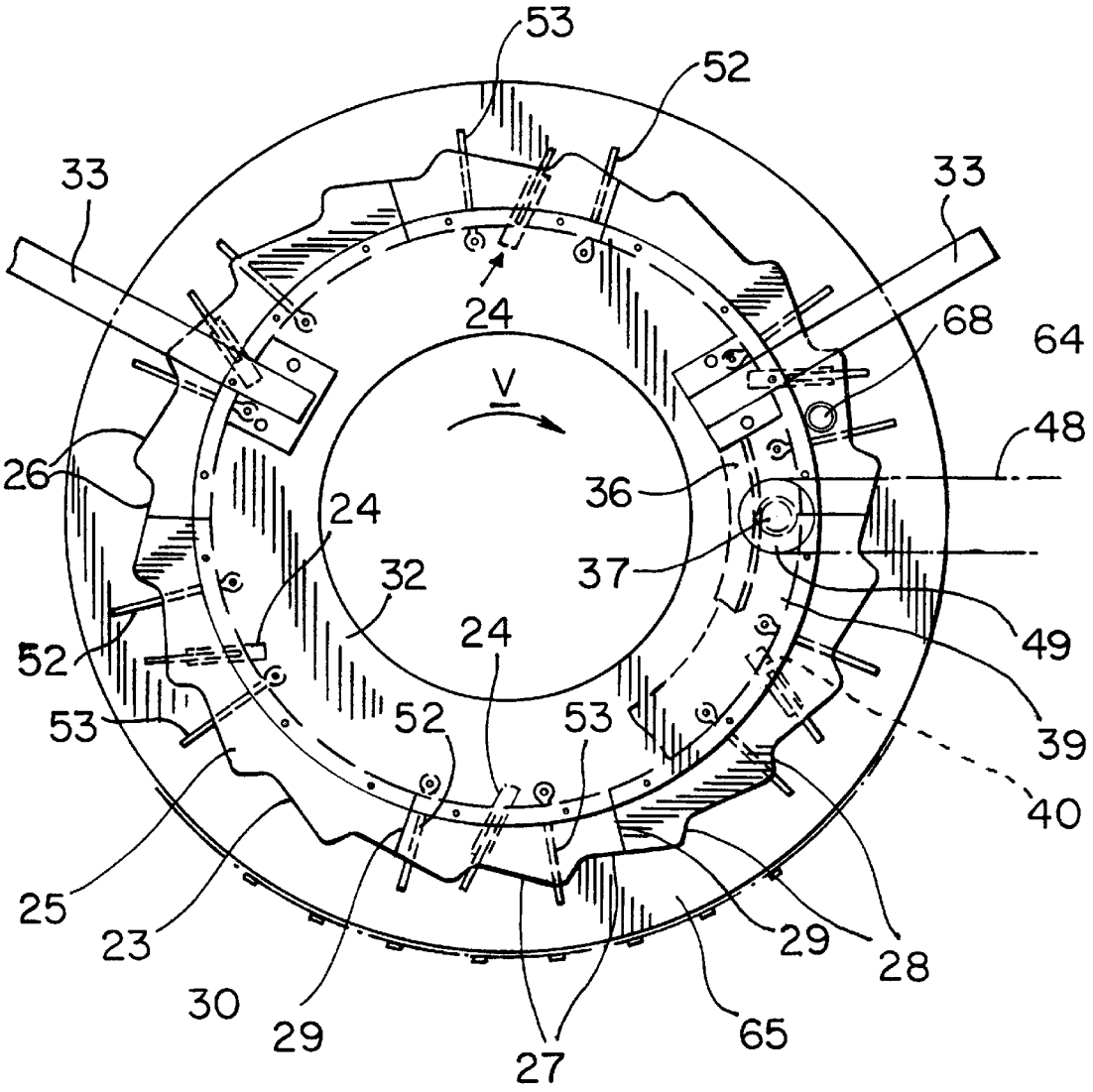
FIG. 2 is a rough schematic top view of the components located within the needle ring of the circular knitting machine of FIG. 1 and are necessary for explaining the cutting device.
Figure 3:
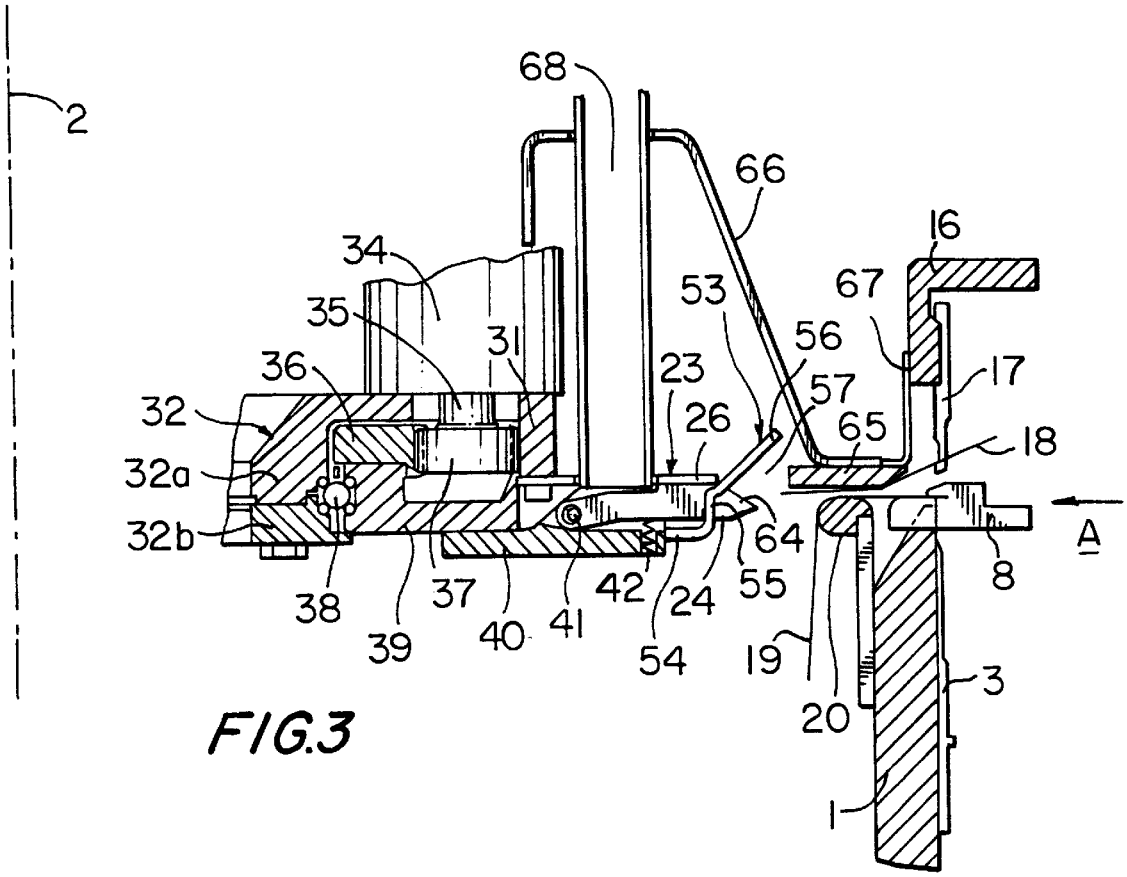
FIG. 3 is a partial sectional view of the circular knitting machine that has been enlarged as compared with FIG. 1.
Figure 5:
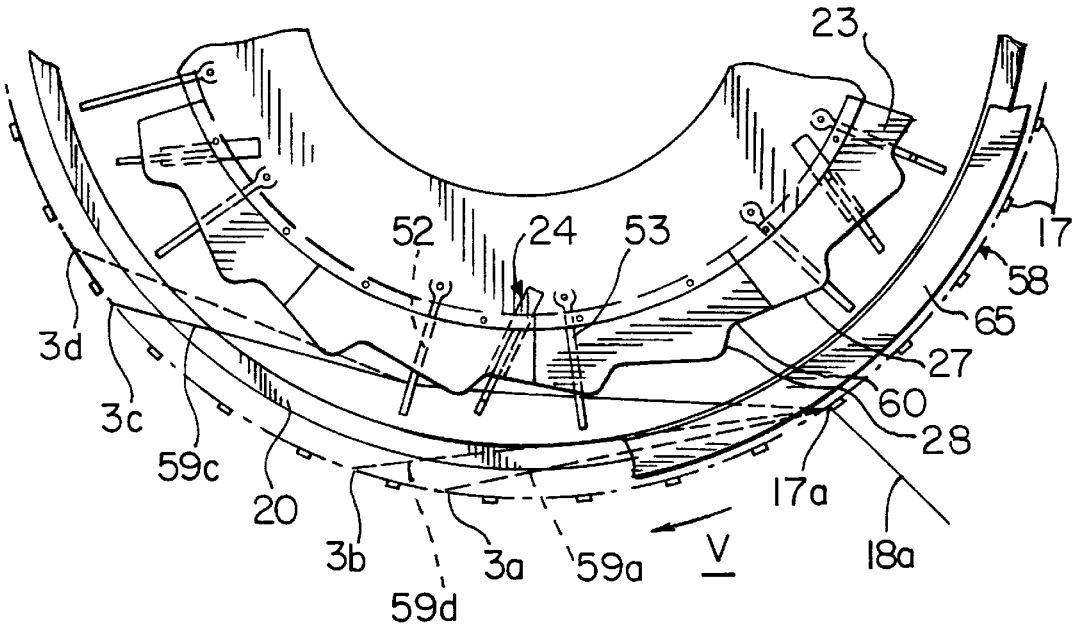
Figure 6:
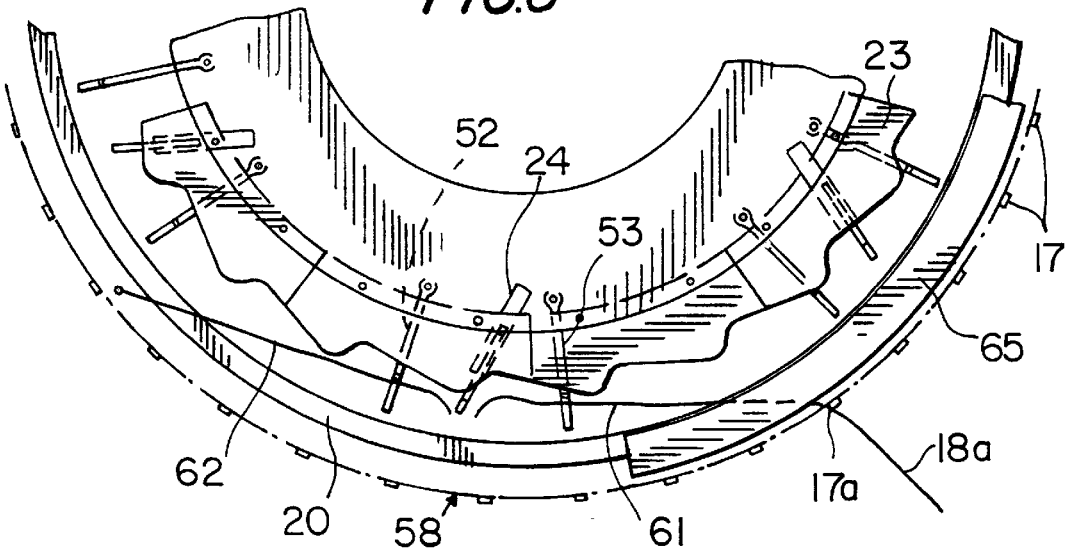
Figure 7:
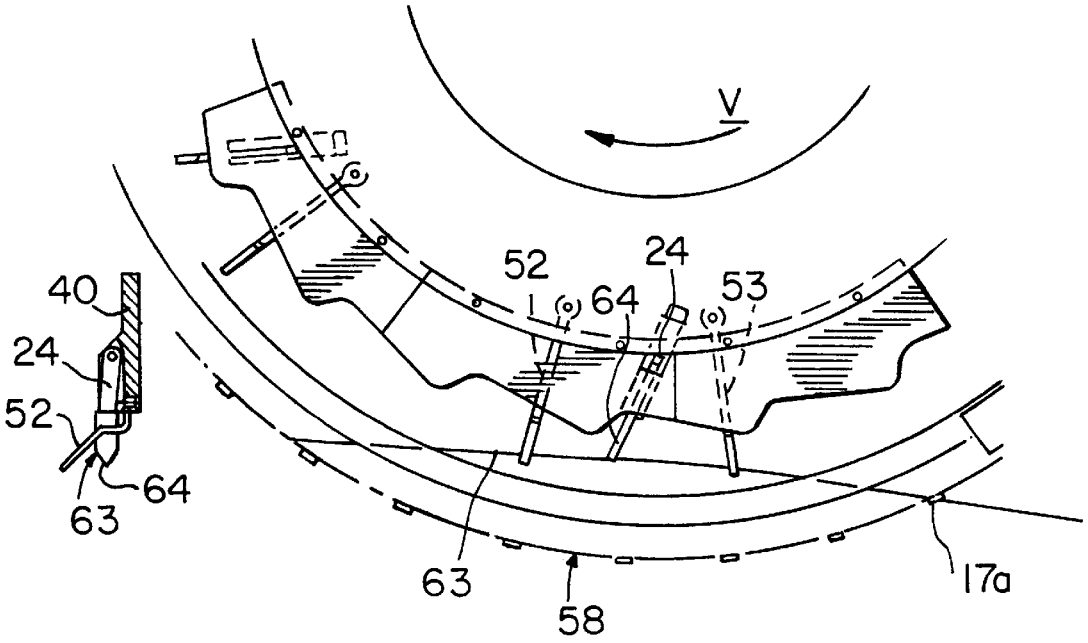
Figure 8:
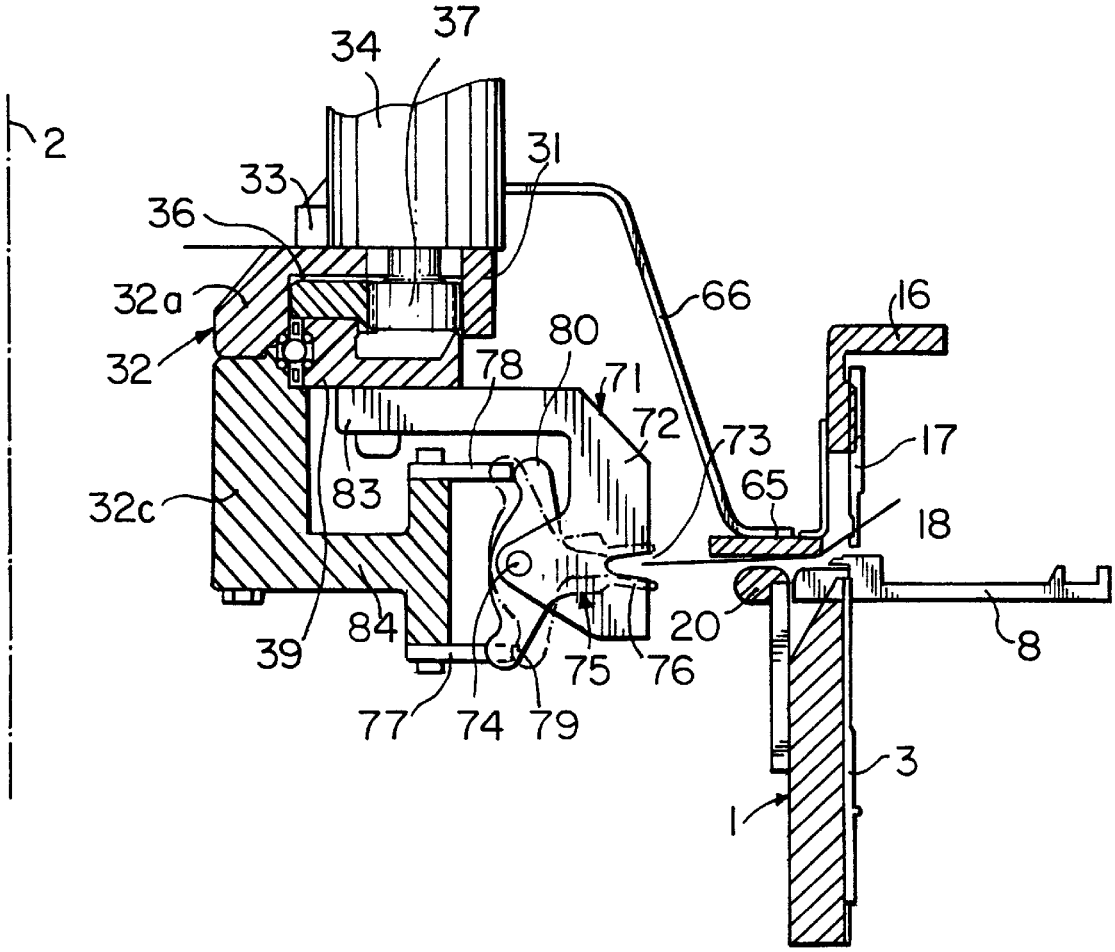
Figure 9:
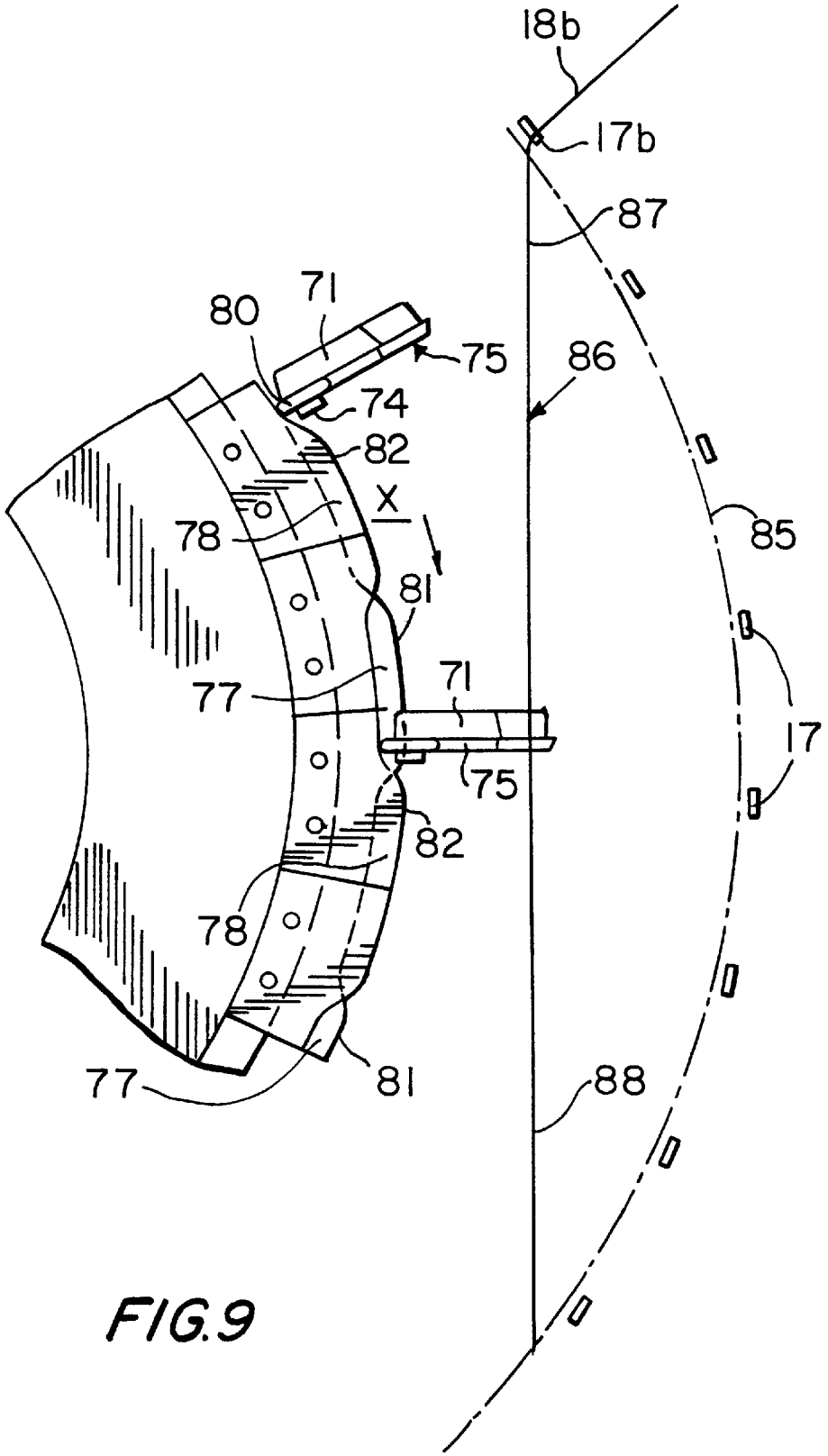

FIGS. 5 to 7, in views similar to FIG. 2, show the mode of operation of the cutting device of the invention in different situations;

FIG. 8 is an enlarged partial sectional view in accordance with FIG. 3 of a circular knitting machine that has a second embodiment of the cutting device of the invention; and FIG. 9 is a rough schematic top view of the components that are located within the needle ring of the circular knitting machine of FIG. 8 and are necessary for explaining the mode of operation of the cutting device.

Figure 1:
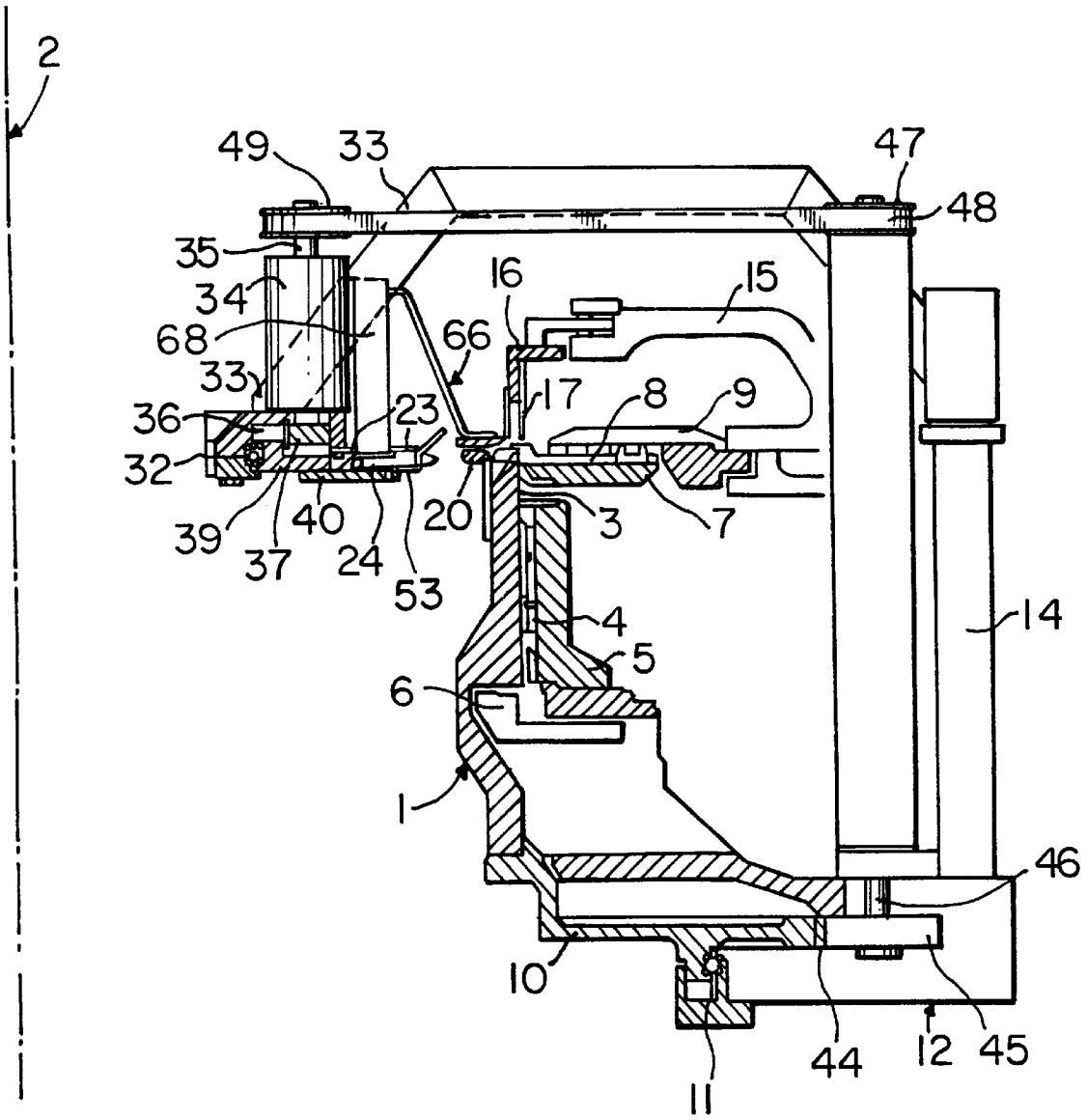
FIG. 1 is a schematic view of a vertical section through a circular knitting machine according to the invention in the area of a cutting device according to the invention.

FIG. 1 is a schematic view of a circular knitting machine of the invention having a needle carrier 1, which in this case is designed as a needle cylinder and can rotate around a vertical axis 2. The direction of rotation is indicated in FIG. 2 by an arrow v, for example. Knitting needles 3 such as common latch needles are mounted so as to be movable up and down in grooves in the needle carrier 1 positioned parallel to the axis 2. The movement of the needles 3 is accomplished by means of cam tracks that are formed in schematically indicated cams 4 of a cam box ring 5. One selection device 6 each, which is known per se (e.g. DE 37 12 673), is housed in the cam box ring 5 on a plurality of knitting systems, by means of which device the needles 3 can be selected in accordance with the pattern. A common sinker ring 7, also bearing-mounted so as to be rotatable and having sinkers 8 and a sinker cam 9, is attached to the needle carrier 1.

The needle carrier 1 is supported by a carrier ring 10, which is mounted in a machine frame 12 by means of bearings 11 so as to be rotatable and can be caused to rotate by a drive apparatus that is not shown in detail. The sinker ring 7 is bearing-mounted and driven in corresponding fashion.

Brackets 15 are mounted on a plurality of columns 14 supported on the circumference of the machine frame 12, which brackets support a yarn guide ring 16 located above its needle carrier 1, on which are mounted in the area of the knitting systems yarn guides 17, by which yarns 18 (FIG. 3) are inserted into the selected needles 3. On the inside upper edge of the needle carrier 1, finally, is mounted a support ring 20 intended to support the knitted fabric 19 that is formed (FIG. 3).

Knitting machines of the type described are generally known to one skilled in the art (DE 31 35 702 A1, DE 31 45 307 A1, DE 38 12 124 C2) and therefore do not need to be described in greater detail. To avoid repetition, the subject of patent DE 38 12 124 C2 (or GB-PS 22 18 114), in particular, is made a subject of the present disclosure by reference.

FIGS. 1 to 7 show a first embodiment of a circular knitting machine according to this invention This embodiment is deemed up to now to be the best one.

In accordance with the invention, the circular knitting machine of FIGS. 1 to 4 has at least one cutting device that contains two cutting elements, one of which in the embodiment is a shearing blade 23 and the other a knife 24. Both cutting elements, as shown in FIGS. 1 and 3 especially, are located more or less in the plane of the needle ring, which is defined by the casting-off edges of the sinkers 9 and by the upper ends of the needles 3 in their lowermost position or by the needle heads. The shearing blade 23 comprises essentially a plate-shaped, fixed ring 25 positioned so as to be coaxial with the needle carrier 1, on the outer circumference of which ring is formed a plurality of sawtooth-shaped recesses 26. The latter are limited by surfaces 27 running essentially in the circumferential direction and by surfaces 28 that are arranged essentially radially but slightly slanted from the inside to the outside and in the direction of rotation (arrow v). In order that the shearing blades 23 or used parts thereof can be replaced easily, they preferably comprise a large number of shearing blade segments 30 adjacent to one another along radial joints 29, which segments are fastened by bolts, for example, on a part 31, located above the ring 25, of a ring-shaped housing 32 that is solidly supported in the machine frame 12 (FIGS. 1, 3) and together form the ring 25. The knife 24, on the other hand, rotates with the needle carrier 1 in the direction of the arrow v (FIG. 2).

For the purpose of assembling the various components of the cutting device, an additional bracket 33 is fastened to the column 14, which bracket protrudes radially past bracket 15 to the inside and supports a bearing pedestal 34 in which a shaft 35 is bearing-mounted so as to be rotatable. Here it is understood that several columns 14 (three, for example) spaced 120° apart and brackets 33 and, optionally, columns for the brackets 33 that are independent of columns 14 can be provided. As shown especially in FIGS. 1 and 3, the ring-shaped housing 32 that is coaxial with the axis 2 is fastened at the lower end of the bracket 33 and the bearing pedestal 34 to an upper part 32*a,* in which a toothed ring 36 with external teeth and a gearwheel 37 meshing with it and mounted on the shaft 35 are bearing-mounted so as to be rotatable. In a lower part 32*b* of the housing 32 a ring-shaped support 39 is mounted by means of a wire bearing 38 or the like so as to be rotatable, which support has one section located on the inside radially that is fastened to the toothed ring 36 by means of bolts and another section located on the outside radially that supports a bracket 40. For the purpose of simplifying assembly, the two housing sections 32*a,b* can be expediently separated from one another and can be connected to one another by bolts or the like. The knife 24 is attached to the bracket 40 and preferably swivel-mounted by being mounted on a swivel pin 41 mounted in the bracket 40 and positioned at right angles to the axis 2 and essentially in the circumferential direction of the shearing blade 23. As shown particularly in FIG. 3, the shearing blade 23 is mounted on the lower end of part 31 of the housing 32 and is therefore stationary. In contrast, the knife is located immediately below the shearing blade 23 and is appropriately pre-tensioned against its underside by means of a spring 42 supported on the bracket 40.

In order to generate rotation of the knife 24, the support ring 10 bearing the needle carrier 1 has a tooth system 44 on its surface that meshes with a gearwheel 45 that is fastened to one end of a rotatable shaft 46 mounted in the machine frame 12 parallel to column 14. At the other end of the shaft 46 there is fastened a belt pulley 47 that is connected by a drive belt 48 to a belt pulley 49 fastened to the shaft 35. Here the transmission ratios can be set so that the drive 34 to 39 and 44 to 49 for the knife 24, which drive is derived from the motion of the needle carrier 1, causes a rotation of the knife 24 at the same speed that the needle carrier 1 has at that moment. However, it is also possible to adjust the transmission ratio so that the knife 24 rotates more slowly or more quickly than the needle carrier 1. In an especially preferred embodiment of the invention the knife 24 rotates at a speed that is somewhat higher, preferably about 10% higher, than the respective speed of the needle carrier 1. For free selection of the transmission ratio, the gearwheel 45 can be replaced by a set of interchangeable gearwheels, or an infinitely variable speed gear drive or the like can be provided somewhere in the drive path.

Figure 4:
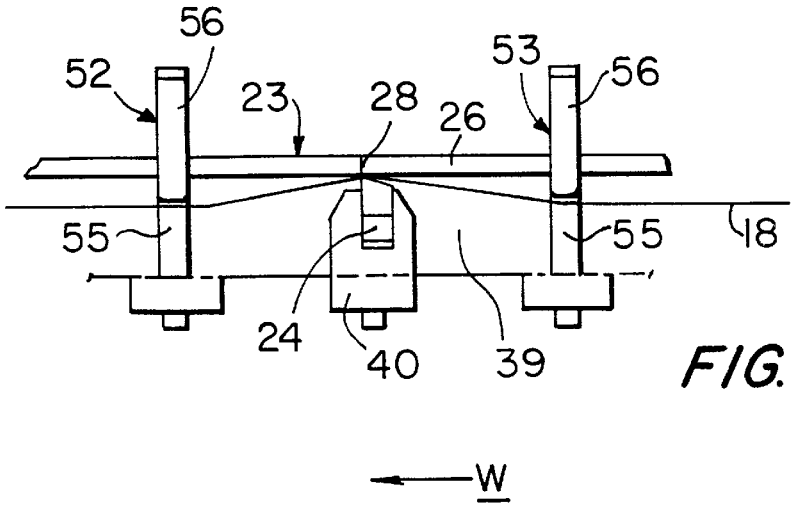
FIG. 4 is a greatly enlarged, schematic view of the essential components of the cutting device of FIGS. 1 to 3 as viewed radially from outside the needle ring and in the direction of arrow A in FIG. 3.

As shown particularly by FIGS. 3 and 4, two catch elements 52 and 53 accompany the knife 24 and, like the knife 24, are fastened to the bracket 40, whereby catch element 52 moves in front of the knife 24 in the direction of arrow w, which corresponds to arrow v in FIG. 2, whereas catch element 53 follows the knife 24. Both catch elements 52, 53 are essentially identical in design and are produced from curved wire bows, for example. They have segments 34 (FIG. 3) facing the outside radially and mounted on the bracket 40, which are angled upward 90° at their free ends, in order to form central sections 55 that run essentially parallel to the axis 2. On their upper ends, which are approximately at the height of the upper side of the knife 24, they are also angled sharply upward and radially outward, which results in end sections 56 that are located above the knife 24 and form with its upper side a V-shaped entry gap 57 for the yarn 18, as indicated in FIG. 3 in particular. In contrast, the central sections 55, as explained below and indicated in FIG. 4, act as stops for the yarns 18 such that during the cutting operation the yarns are positioned in a radial direction or cannot move further inside radially.

The mode of operation of the cutting device of the invention shall be described in greater detail in the following in connection with FIGS. 5 to 7, in each of which a needle ring 58 is shall be described in greater indicated by broken lines, along which ring a large number of yarn guides 17 that guide the yarns 18 is located. Therefore it is assumed in FIGS. 5 and 6 that a yarn 18*a* is guided by a yarn guide 17*a* and that the last needle 3 that has held this yarn 18*a* moves on in the direction of arrow v through positions 3*a* and 3*b,* indicated by broken lines, to a position 3*c*. As a consequence of this, a yarn float 59*a* is formed in the inside of the needle ring 58, which float is positioned relative to it like a chord or string and gradually becomes longer and longer, until the yarn float 59*c* has formed when the associated needle is in position 3*c*. As soon as the yarn float 59*c* has attained a given minimum length, which is a function of the position of the cutting device relative to the needle ring 58, it first enters the range of action of catch element 52 and subsequently also the range of action of catch element 53. The float 59*c* that is caught in this way then moves, as shown especially by FIG. 3, in the area of the V-shaped entry gap 57 along the lower sides of sections 56 of the catch elements 52, 53 in the direction of the surface of the cutting knife 24, until it finally runs onto the middle sections 55 of the catch elements 52, 53 and then can no longer be pushed further to the inside radially. Thus this position is also maintained when the needle from which this yarn float 59*c* originates moves beyond position 3*c* to position 3*d*, for example. The catch elements 52, 53 thereby ensure that this yarn float 59*c* ends up lying on the upper edge of the knife 24, which in FIG. 4 is the left edge. Moreover, the given radial position ensures that when the knife 24 and the catch elements 52, 53 rotate in the direction of arrow v the float 59*c* can only run up onto a front or middle section of the stationary surfaces 28 of the shearing blade 23 but not as far as that point 60 (FIG. 5) where surfaces 27 and 28 run together, which is not favorable for a shearing and cutting operation. Aside from this, it is clear that any desired positioning of the float 59*c* relative to the knife 24 and to the shearing blade 23 can be created by means of an appropriate design of the catch elements 52 and 53.

Thus in its further travel the yarn float 59*c* reaches, for one thing, the upper edge of the rotating knife 24 and, for another thing, a lower edge of the surface 28 of the stationary shearing blade 23, so that the float is cut in two as shown in FIGS. 4 and 6. The result is a yarn end 61 on the thread guide side and a yarn end 62 on the fabric side that rotates with the needle 3*d* located at the beginning of the float 59*c* and then is gradually drawn off along with the knitted fabric 19 being formed (FIG. 3). The yarn end 61 on the yarn guide side, in contrast, is deposited in a known manner in a position crossing the needle ring 58 on the upper side of the knitted fabric 19 being formed and remains there until it is again picked up by a needle 3 that is selected on the knitting system attached to the yarn guide 17*a*.

In the cutting operation described above, the invention offers the advantage that at the least the knife 24 and the catch elements 52, 53 rotate together with the needles located at the beginning of the floats. This avoids a situation in which the part of the float 59*c* forming the yarn end 62 is stretched before or during the cutting operation, recoils in an uncontrolled manner after the cutting operation, and then under certain circumstances is picked up again by the needles and worked to form undesired yarn loops or stitches. If the unit formed by the knife 24 and the catch elements 52, 53 rotates more rapidly than the needle cylinder—10% faster, for example—then this also means that the knife 24 briefly gets closer and closer to the needle that forms the beginning of the float 59*c* before, during and after the cutting operation and thereby prevents the yarn end 62 from being stretched. It also prevents yarn sections from being pulled out unintentionally from already formed stitches, tuck loops, or plush loops or the like.

Another advantage of the higher speed of rotation of the knife 24 as preferred in the invention is shown in FIG. 7. There a yarn float 63 is shown, which at the moment is located radially in the outer section of the entry gap 57 (FIG. 3) and therefore has not yet reached the actual cutting area, as shown by the sectional view in the left-hand portion of FIG. 7. If the length of this float 63 remains constant as a result of the fact that needles on the knitting system attached to the yarn guide 17*a* are again selected to pick up the yarn, then the knife 24 gradually moves out of the range of the yam float 63 due to its higher speed of rotation, so that the float cannot obstruct the cutting operation for other floats of sufficient length.

As shown particularly by FIG. 3 and the sectional view in FIG. 7, the knife 24 preferably has a surface 64 in its radially external area that is chamfered in a manner opposite to the segments 56 of the catch elements 52, 53. This means that for one thing a sufficiently large, effective entry gap 57 is formed, which facilitates reliable catching of sufficiently long floats and reliable transfer of them to the cutting area, whereas for another thing the surface 64 can act as a deflecting edge for excessively short floats and prevent them from getting into the cutting area.

Right above the sinkers 8 (FIGS. 1 and 3) is preferably mounted a hold-down ring 65 that is only partially shown in FIGS. 5 and 6 extends radially to the entry gap 57. This hold-down ring 65 prevents the yarn ends 61 on the yarn guide side (FIG. 6) and also newly formed floats from rising up and winding around the catch elements 52, 53 or the knife 24 and/or prevents yarn from being further pulled out of the yarn guides 17 in an uncontrolled manner.

Above the cutting devices, furthermore, is located a protective cover 66 that is only shown in FIG. 3 and can be conical, for example, which covers primarily the space between the hold-down ring 65 and the rotating knives 24. This prevents the operator from reaching into the rotating knives when the machine is running. Both the hold-down ring 65 and the protective cover 66 are mounted on the yarn guide ring 16 by means of a bracket 67, for example.

Finally, as shown particularly by FIGS. 1 and 3, at least one blower nozzle 68 attached to the cutting device is provided. It comprises, advisably, a tube located parallel to the axis 2 and essentially above the shearing blade 23, the upper end of which tube is connected to a source of compressed air (not shown) and the lower end of which protrudes through an appropriate penetration in the shearing blade 23. This lower end is directed at the area through which the knives 24 and the catch elements 52, 53 pass such that any yarn parts caught on them are blown away in a downward direction and cannot interfere with proper operation of the cutting device. The yarn parts blown away then end up in the fabric hose, where they cannot cause any damage.

The embodiment shown in FIGS. 8 and 9 differs from that shown in FIGS. 1 to 7 essentially only in the fact that a rotating shearing blade 71 is provided instead of a stationary shearing blade 23. Therefore, like parts are designated by the same reference characters in FIGS. 8 and 9.

The shearing blade 71 comprises a preferably thin, plane-parallel, plate-shaped component 72 that is essentially parallel to the axis 2 and whose wide sides are oriented radially, which component has on its radially external long side a catch element 73 designed as a V-shaped cutout and lying essentially in the plane of the needle ring. A knife 75 is mounted pivotally on a central, rear portion of the component 72 by means of a pivot pin 74 arranged at right angles to it, which knife has a flat cutting edge 76 and is in immediate contact with the wide side of the shearing blade 71 that is the leading side in the direction of rotation (arrow x in FIG. 9), so that the knife is parallel to the shearing blade 71 and can be swung back and forth in contact with it. The cutting edge 76 is positioned so that it can pass through the V-shaped catch element 73 of the shearing blade 71 when the knife 75 is pivoted, whereby its upper edge interacts with the upper edge of the catch element 73 and/or its lower edge with the lower edge of the catch element 73 in the manner of a shear. The upper and lower edges of the knife 75 and the catch element 73 are preferably designed as cutting edges for this purpose. By this means any yarns 18 located in the V-shaped catch element 73 are cut in two when the knife 75 is pivoted into the position indicated in FIG. 8 by the broken line and/or when the knife 75 is swung back into the position indicated by the solid line. As in the embodiment that was described first, there are us two cutting elements (71, 74), but both cutting elements are subjected at the same time to rotation around the axis 2. The V-shaped cutout in the shearing blade has a triple function since it forms at the same time a cutting edge that interacts with the knife 75, the catch element 73, and a V-shaped entry gap for the floats, as is explained below.

In order to pivot the knife 75, two stationary control parts 77 and 78 positioned axially one above the other are provided on the rear of the knife, which parts interact with protrusions 79, 80 on the rear of the knife 75 appropriately positioned axially one above the other. The control parts 78 visible in FIG. 9 and the control parts 77 that are partially covered over in FIG. 9 have control cams 81 and 82 that alternately rise up radially to the outside and drop down again. As a result the knife 75 is alternately pivoted during its rotation to the positions shown in FIG. 8 by the broken and solid lines, respectively, in the distance between the control cams 81,82.

The common assembly and the movement of the shearing blade 71 and the knife 75 are accomplished in a manner similar to that shown in FIGS. 1 to 7. On the rear of the shearing blade 71 a bracket 83 is provided that is fastened to the support 39 by means of a bolt, for example. In place of the housing section 32*b* (FIG. 3), a housing section 32*c* is provided, which is connected to housing section 32*a* and has a radially protruding arm 84 that supports the two control parts 77, 78, which are connected to it by bolts, for example. Here the configuration is preferably such, analogous to FIGS. 1 to 7, that the knife 75 and along with it the shearing blade 71 rotate at a speed that is higher, preferably about 10% higher, than the speed of the needle carrier 1. The gearwheel 37 is driven preferably in the same way as has been described above with reference to FIG. 1.

The cutting device as shown in FIGS. 8 and 9 essentially operates as follows:

FIG. 9, like FIGS. 5 to 7, indicates a needle ring 85 and a yarn guide 17*b,* which guides a yam 18*b* and from which originates a yarn float 86. If this float 86 reaches a certain minimum length, then it is automatically caught by a catch element 73 of a cutting device revolving together with the needle ring 85 and the needle carrier 1 and is pressed deeper and deeper into the V-shaped entry gap. If one of the projections 79, 80 of the knife 76 then comes in contact with a corresponding control cam 81, 82, then the knife's cutting blade 76 is swung upwards from below or downwards from above past the lateral edges that limit the V-shaped cutout of the shearing blade and act as cutting edges, whereby the float 86 is sheared off or cut in two and a yarn end 87 on the yarn guide side and a yarn end 88 on the fabric side result. As in the embodiment shown in FIGS. 1 to 7, the advantage is achieved that the yarn end 88 on the fabric side is not stretched during the cutting operation. In contrast to FIGS. 1 to 7 there is even the additional advantage that both cutting elements 71, 75 rotate and therefore it is possible to guarantee a complete release of pressure on the yarn end 88, especially at a speed of rotation that is higher than that of the needle carrier.

Otherwise the knitting machine as shown in FIGS. 8 and 9, like the knitting machine shown in FIGS. 1 to 7, is also provided preferably with the hold-down ring 65, the protective cover 66, and at least one blower nozzle (not shown). In the circumferential direction of the circular knitting machine several identical cutting devices are preferably also provided (FIG. 9), which are all designed as was described with reference to FIG. 8.

The invention is not limited to the described embodiments, which can be varied in multiple ways. This applies first of all to the term "knitting needles 3," in whose place other suitable knitting tools such as slide needles or plush hooks could also be provided, so that the term "knitting needles" covers all knitting tools of a similar type. It is also understood that the catch elements 52, 53 can be designed differently than is shown in the drawing and that additional catch elements corresponding to catch elements 52, 53 can also accompany the shearing blade 71 shown in FIGS. 8 and 9. Furthermore it is understood that the drive shown in FIG. 1 for the rotating parts of the cutting devices is only one example and could be modified in any suitable manner. Furthermore the invention is not limited to the shearing blade and knife combinations described, which can be modified in numerous ways. In particular, it would be possible, as FIG. 4 shows, for example, to allow the corresponding shearing surfaces and shearing edges of the shearing blades and knives to engage with one another not exactly parallel to one another but rather at a slight angle of 1° to 5° to one another, for example, in order to obtain a situation in which the shearing edges come in contact at only one point, if possible, and a self-shearing effect is achieved. Furthermore, at a minimum the brackets 33 are preferably mounted on the columns 14 so that they are adjustable in height, so that the cutting devices, particularly the catch elements, can be precisely adjusted relative to the plane in which the yarn floats end up lying. Finally it is understood that the various components can also be used in combinations other than those shown and described.

The cutting device described above is intended particularly for use with large circular knitting machines (needle cylinder diameter greater than 165 mm), although it could also be used with small circular knitting machines having smaller diameters, if necessary. Further, it is of course also possible that the knitting machines have a stationary needle cylinder whereas the cams 5 and 9 as well as the yarn guides 17 are mounted for rotation around axis 2. In such a case, the shearing blade 23 can rotate with the cams and yarn guides, whereas the knife 24 and the catch elements 52, 53 remain stationary or are rotated around axis 2 at low speed, respectively, if the embodiment according to FIGS. 1 to 7 is used. In the embodiment according to FIGS. 8 and 9 it would be possible for the same purpose to stationary mount the combination of shearing blade 71, knife 75 and catch element 73 or to rotate this combination at low speed, respectively.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention, that others can, by applying current knowledge, radily adapt it for various applications without omitting features that, from the standpoint of prior art, fairly constitute essential characteristics of the generic or specific aspects of this invention.

What is claimed as new and described to be protected by Letters Patent is set forth in the appended claims:

1. Circular knitting machine for knitting patterned knitted fabrics (19), comprising a rotatable needle carrier (1) having knitting needles (3) distributed along a needle circle (58, 85); a plurality of yarn guides (17) located on a circumference of the needle circle (58, 85) for feeding yarns (18) to the knitting needles (3); selection devices (6) for selecting the knitting needles (3) in accordance with a pattern and being assigned to the yarn guides (17), said yarn guides (17) and selection devices (6) being so designed and positioned that the yarns (18) are only caught by the knitting needles (3) selected by said selection devices and then tied into the knitted fabric (19) whereas the knitting needles (3) not selected by said selection devices (6) pass the yarns (18) with formation of yarn floats (59*a,b,c,* 86) that form yarn chords protruding into the needle circle (58; 85); and at least one cutting device located inside the needle circle (58, 85) for cutting through the yarn floats (59, 86) of a given minimum length such that yarn ends (62, 68) on a fabric side and yarn ends (61, 87) on a yarn guide side are formed and the yarn ends (61, 87) on the yarn guide side remain in a position intersecting the needle circle (58, 85) within a catchment area of the selected knitting needles (3), said cutting device having two cooperating cutting elements (23, 24 and 71, 75) respectively, of which the one cutting element is a shearing blade (23, 71) and the other cutting element is a knife (24, 75), said knife (24, 75) being mounted for rotation with said needle carrier (1), and at least one catch element means (52, 53 or 73) associated with the knife (24, 75) for positioning the yarn floats (59, 86) relative to the cutting elements (23, 24 and 71, 75) and being mounted for rotation with said knife (24, 75); and means (34–39, 44–49) for rotating said needle carrier (1), said knife (24, 75) and said catch element means (52, 53 or 73).

2. Circular knitting machine for knitting patterned knitted fabrics (19), comprising a needle carrier (1) having knitted needles (3) distributed along a needle ring (58, 85), selection devices (6) for selecting the knitting needles (3) in accordance with the pattern, a plurality of yarn guides (17) located on a circumference of the needle ring (58, 85) and assigned to the selection devices (6) for feeding yarns (18) to the knitting needles (3), whereby these yarn guides (17) are positioned so that the yarns (18) are caught by selected knitting needles (3) and tied into the knitted fabric (19) but are passed over by non-selected knitting needles (3) with the formation of yarn floats (59*a b, c;* 86) that form yarn chords protruding into the needle ring (58, 85), and at least one cutting device located inside the needle ring (58, 85) for cutting through yarn floats (59, 86) of a given minimum length such that yarn ends on a fabric side and on a yarn guide side (62, 88 and 61, 87, respectively) are formed and the yarn ends on the yarn guide side (61, 87) remain in a position intersecting the needle ring (58, 85) in the catchment area of the selected knitting needles (3), wherein the cutting device has two cutting elements (23, 24 and 71, 75 respectively), of which the one is a knife (24,75) and the other is a shearing blade (23, 71) assigned to it, at least one catch element (52, 53 or 73) associated with the knife (24, 75) for positioning the yarn floats (59, 86) relative to the cutting elements (23, 24 and 71, 75), and the knife (24) is positioned beneath the shearing blade (23).

3. Circular knitting machine for knitting patterned knitted fabrics (19), comprising a needle carrier (1) having knitted needles (3) distributed along a needle ring (58, 85), selection devices (6) for selecting the knitting needles (3) in accordance with the pattern, a plurality of yarn guides (17) located on a circumference of the needle ring (58, 85) and assigned to the selection devices (6) for feeding yarns (18) to the knitting needles (3), whereby these yarn guides (17) are positioned so that the yarns (18) are caught by selected knitting needles (3) and tied into the knitted fabric (19) but are passed over by non-selected knitting needles (3) with the formation of yarn floats (59*a b, c;* 86) that form yarn chords protruding into the needle ring (58, 85), and at least one cutting device located inside the needle ring (58, 85) for cutting through yarn floats (59, 86) of a given minimum length such that yarn ends on a fabric side and on a yarn guide side (62, 88 and 61, 87, respectively) are formed and the yarn ends on the yarn guide side (61, 87) remain in a position intersecting the needle ring (58, 85) in the catchment area of the selected knitting needles (3), wherein the cutting device has two cutting elements (23, 24 and 71, 75 respectively), of which the one is a knife (24, 75) and the other is a shearing blade (23, 71) assigned to it, at least one catch element (52, 53 or 73) associated with the knife (24, 75) for positioning the yarn floats (59, 86) relative to the cutting elements (23, 24 and 71, 75), and a hold-down ring (65) is provided right above the needle carrier (1).

4. Circular knitting machine for knitting patterned knitted fabrics (19), comprising a needle carrier (1) having knitted needles (3) distributed along a needle ring (58, 85), selection devices (6) for selecting the knitting needles (3) in accordance with the pattern, a plurality of yarn guides (17) located on a circumference of the needle ring (58, 85) and assigned to the selection devices (6) for feeding yarns (18) to the knitting needles (3), whereby these yarn guides (17) are positioned so that the yarns (18) are caught by selected knitting needles (3) and tied into the knitted fabric (19) but are passed over by non-selected knitting needles (3) with the formation of yarn floats (59*a b, c;* 86) that form yarn chords protruding into the needle ring (58, 85), and at least one cutting device located inside the needle ring (58, 85) for cutting through yarn floats (59, 86) of a given minimum length such that yarn ends on a fabric side and on a yarn guide side (62, 88 and 61, 87, respectively) are formed and the yarn ends on the yarn guide side (61, 87) remain in a position intersecting the needle ring (58, 85) in the catchment area of the selected knitting needles (3), wherein the cutting device has two cutting elements (23, 24 and 71, 75 respectively), of which the one is a knife (24,75) and the other is a shearing blade (23, 71) assigned to it, at least one catch element (52, 53 or 73) associated with the knife (24, 75) for positioning the yarn floats (59, 86) relative to the cutting elements (23, 24 and 71, 75), and a protective cover (66) for the cutting device (s) is provided above the needle carrier (1).

5. Circular knitting machine for knitting patterned knitted fabrics (19), comprising a needle carrier (1) having knitted needles (3) distributed along a needle ring (58, 85), selection devices (6) for selecting the knitting needles (3) in accordance with the pattern, a plurality of yarn guides (17) located on a circumference of the needle ring (58, 85) and assigned to the selection devices (6) for feeding yarns (18) to the knitting needles (3), whereby these yarn guides (17) are positioned so that the yarns (18) are caught by selected knitting needles (3) and tied into the knitted fabric (19) but are passed over by non-selected knitting needles (3) with the formation of yarn floats (59*a b, c;* 86) that form yarn chords protruding into the needle ring (58, 85), and at least one cutting device located inside the needle ring (58, 85) for cutting through yarn floats (59, 86) of a given minimum length such that yarn ends on a fabric side and on a yarn guide side (62, 88 and 61, 87, respectively) are formed and the yarn ends on the yarn guide side (61, 87) remain in a position intersecting the needle ring (58, 85) in the catchment area of the selected knitting needles (3), wherein the cutting device has two cutting elements (23, 24 and 71, 75 respectively), of which the one is a knife (24, 75) and the other is a shearing blade (23, 71) assigned to it, at least one catch element (52, 53 or 73) associated with the knife (24, 75) for positioning the yarn floats (59, 86) relative to the cutting elements (23, 24 and 71, 75), the needle carrier (1) is rotatably mounted around an axis (2) and that the knife (24, 75) and preferably also the catch element (52, 53; 73) rotates with the needle carrier (1), and means are provided by which the speed at which the knife (24, 750 rotates can be adjusted to a value that differs from the needle carrier speed.

6. Circular knitting machine of claim 5, characterized in that the speed for the knife (24, 75) can be adjusted to a value approximately 10% higher than the needle carrier speed.

7. Circular knitting machine according to claim 5, characterized in that a drive derived from the needle carrier motion (35–39, 45–49) is provided to produce the rotation of the knife (24, 75) and the means comprise replaceable gear wheels of the drive.

8. Circular knitting machine of claim 1, characterized in that the shearing blade (23) comprises a stationary ring (25) located inside of and substantially coaxial with the needle circle (58), said stationary ring (25) being provided on its circumference with sawtooth-shaped recesses (26) that form shearing edges.

9. Circular knitting machine according to claim 1, characterized in that said catch element means comprises at least two catch elements (52, 53) one of which being on one side of the knife (24) and another one of which being on another side of the knife (24).

10. Circular knitting machine 9, characterized in that at least one catch element (52, 53) has a radial segment (55) for positioning the yarn floats (59) in a radial direction with respect to the shearing blade (23) during the cutting operation.

11. Circular knitting machine of claim 8, characterized in that the shearing blade (23) comprises a plurality of segments (30).

12. Circular knitting machine according to claim 1, characterized in that the knife (24) is positioned beneath the shearing blade (23).

13. Circular knitting machine of claim 9, characterized in that the catch elements (52,53) and an upper side of the knife (24) form a V-shaped entry gap for the thread floats.

14. Circular knitting machine according to claim 1, characterized in that the knife (24) is pre-tensioned against the shearing blade (23) by a spring (42).

15. Circular knitting machine according to claim 1, characterized in that there are several cutting devices that have several knives (24) and catch elements (52, 53) distributed in a circumferential direction and a single shearing blade (23) assigned to all knives (24) and catch elements (52, 53) in common.

16. Circular knitting machine of claim 15, characterized in that the shearing blade (71) comprises a component (72) directly associated with the knife (75), the knife is pivotally mounted in or on the component (72), and stationary control cams (81, 82) intended for pivoting the knife (75) are provided.

17. Circular knitting machine of claim 11, characterized in that the catch element (73) comprises a V-shaped cutout in the shearing blade (72).

18. Circular knitting machine of claim 11 or 12, characterized in that it contains several cutting devices distributed in the circumferential direction, each of which has a shearing blade (71) and a knife (75) pivotally mounted in the latter.

19. Circular knitting machine according to claim 1, characterized in that at least one blower nozzle (68) accompanies the cutting device.

20. Circular knitting machine according to claim 19, characterized in that the blower nozzle (68) is located essentially parallel to the axis (2) of the needle carrier (1) and directed from the top through a recess in the shearing blade (23) to an area though which the knife (24) and the catch element (52,53) pass.

21. Circular knitting machine according to claim 1, characterized in that a hold-down ring (65) is provided right above the needle carrier (1).

22. Circular knitting machine according to claim 1, characterized in that a protective cover (66) for the cutting device(s) is provided above the needle carrier (1).

23. Circular knitting machine of claim 5, characterized in that the speed for the knife (24, 75) can be adjusted to a value approximately 10% higher than the needle carrier speed.

24. Circular knitting machine according to claim 5, characterized in that a drive derived from the needle carrier motion (35–39, 45–49) is provided to produce the rotation of the knife (24, 75) and the means comprise replaceable gear wheels of the drive.

25. Circular knitting machine according to claim 1, characterized in that means are provided for adjusting a speed at which the knife (24, 75) rotates to a value that differs from a needle carrier speed.

26. Circular knitting machine according to claim 1, characterized in that the knife (24, 75) rotates with a speed which differs from a needle carrier speed.

* * * * *